US005080822A

United States Patent [19]

VanEenam

[11] Patent Number: 5,080,822

[45] Date of Patent: * Jan. 14, 1992

[54] AQUEOUS DEGREASER COMPOSITIONS CONTAINING AN ORGANIC SOLVENT AND A SOLUBILIZING COUPLER

[75] Inventor: Donald N. VanEenam, Des Peres, Mo.

[73] Assignee: Buckeye International, Inc., St. Louis, Mo.

[ * ] Notice: The portion of the term of this patent subsequent to Jan. 14, 2009 has been disclaimed.

[21] Appl. No.: 507,197

[22] Filed: Apr. 10, 1990

[51] Int. Cl.[5] ..... C11D 3/43; C11D 7/52; C23G 5/032

[52] U.S. Cl. ..... 252/170; 252/171; 252/172; 252/153; 252/DIG. 14; 252/550; 252/553; 252/558; 252/364

[58] Field of Search ..... 252/170, 558, 153, DIG. 14, 252/364, 172, 553, 171, 550

[56] References Cited

U.S. PATENT DOCUMENTS

| | | | |
|---|---|---|---|
| 3,591,510 | 7/1971 | Zenk | 252/526 |
| 3,923,537 | 12/1975 | Wood | 106/277 |
| 4,040,977 | 8/1977 | Eggensperger et al. | 252/401 |
| 4,248,928 | 2/1981 | Spadini et al. | 428/286 |
| 4,264,466 | 4/1981 | Carleton et al. | 252/99 |
| 4,414,128 | 11/1983 | Goffinet | 252/111 |
| 4,460,374 | 7/1984 | Abel | 8/501 |
| 4,472,291 | 9/1984 | Rosano | 252/186.28 |
| 4,559,150 | 12/1985 | Becker et al. | 252/8.6 |
| 4,576,738 | 3/1986 | Colodney et al. | 252/559 |
| 4,606,840 | 8/1986 | Gautier et al. | 252/171 |
| 4,758,377 | 7/1988 | Iding | 252/556 |
| 4,769,172 | 9/1988 | Siklosi | 252/153 |
| 4,776,974 | 10/1988 | Stanton et al. | 252/106 |
| 4,832,802 | 5/1989 | Canaris | 204/44.2 |
| 4,861,512 | 8/1989 | Gosselink . | |

*Primary Examiner*—Paul Lieberman
*Assistant Examiner*—Erin M. Higgins
*Attorney, Agent, or Firm*—Senniger, Powers, Leavitt & Roedel

[57] ABSTRACT

Stable, aqueous degreaser compositions are formulated in the form of totally water soluble solutions containing at least one sparingly soluble organic solvent having specified compositional characteristics, a solubilizing coupler and water. The solubilizing coupler has a surface tension in excess of approximately 45 dynes/cm (at concentrations of approximately 0.01–1.0%) and is present in an amount not substantially exceeding twenty-five percent more than the minmum amount required to completely solubilize the organic solvent. The compositions so formulated exhibit markedly improved degreasing efficacy.

22 Claims, No Drawings

AQUEOUS DEGREASER COMPOSITIONS CONTAINING AN ORGANIC SOLVENT AND A SOLUBILIZING COUPLER

BACKGROUND OF THE INVENTION

This invention relates to degreaser compositions and, more particularly, to stable, aqueous degreaser compositions in the form of totally water soluble solutions which exhibit markedly improved degreasing capability.

Heretofore, it has been the practice to employ as degreaser compositions pure aqueous insoluble solvents such as kerosene, odorless mineral spirits or 1, 1, 2-trichloroethane or such solvents emulsified in water with suitable surfactants. Such compositions are generally used in solvent (solution) or vapor phase degreasing. For vapor phase degreasing, it is essential that the vapors be contained in order to effect degreasing. This necessitates high capital costs for equipment, solvent and vapor recovery, recycling and containment. Previously used degreaser compositions also suffer from the drawbacks of being generally combustible, non-biodegradable, toxic, having a high VOC (volatile organic compound) content, costly and of a somewhat objectionable odor.

In my copending, coassigned application Ser. No. 373,813, filed June 29, 1989, there is disclosed improved aqueous cleaner/degreaser compositions which are formulated in the form of totally water soluble solutions and which contain (a) at least one sparingly water soluble organic solvent having certain defined characteristics; (b) a solubilizing additive consisting of from approximately 0.1 to approximately 100 weight percent of a surfactant and from 0 to approximately 99.9 weight percent of a coupler with the solubilizing additive being present in an amount not exceeding approximately tenfold that required to completely solubilize the organic solvent; and (c) water. While these compositions display greatly improved cleaner/degreaser efficacy over conventional and available cleaner/degreaser compositions, there remains a need for low or no foam compositions (i.e., containing no foaming surfactants) with still greater degreasing capability which can be formulated as totally water soluble solutions and which do not possess the deficiencies of presently available degreaser compositions.

SUMMARY OF THE INVENTION

Among the several objects of the invention may be noted the provision of stable, aqueous degreaser compositions having superior degreasing efficacy; the provision of such compositions which are less or even totally non-combustible, generally contain lower VOC levels, are less toxicologically hazardous, less costly and easier to store than available degreaser compositions; the provision of aqueous compositions of this type which incorporate organic solvents with inherently limited aqueous solubility; and the provision of such compositions which may be readily formulated from available components. Other objects and features will be in part apparent and in part pointed out hereinafter.

Briefly, the present invention is directed to stable, aqueous degreaser compositions which are formulated in the form of totally water soluble solutions. The compositions comprise:

(a) at least one sparingly water soluble organic solvent characterized by:
  (i) having a water solubility in the range of approximately 0.2 to approximately 6 weight percent;
  (ii) not being a hydrocarbon or halocarbon;
  (iii) having one or more similar or dissimilar oxygen, nitrogen, sulfur or phosphorous containing functional groups;
  (iv) being a solvent for hydrophobic soilants; and
  (v) being present in an amount exceeding its aqueous solubility;

(b) a solubilizing coupler having a surface tension in excess of approximately 45 dynes/cm (at concentrations of approximately 0.01–1.0%) and being present in an amount not substantially exceeding twenty-five percent more than the minimum amount required to completely solubilize the organic solvent; and (c) water.

The compositions of the invention exhibit markedly improved degreasing efficacy over that achievable with available degreasing compositions.

DESCRIPTION OF THE PREFERRED EMBODIMENTS

In accordance with the present invention, it has now been found that stable, totally water soluble, aqueous degreaser compositions having superior degreasing capabilities can be formulated by combining at least one sparingly water soluble organic solvent having certain defined characteristics and being present in an amount exceeding its aqueous solubility with a solubilizing coupler and water, the solubilizing coupler having a surface tension in excess of approximately 45 dynes/cm (at concentrations of approximately 0.01–1.0%) and being present in an amount not substantially exceeding twenty-five percent more than the minimum amount required to completely solubilize the organic solvent. Unexpectedly, as demonstrated by the experimental data presented hereinafter, it has been discovered that the optimum degreasing efficacy is attained by utilizing an organic solvent of inherently low or limited water solubility and rendering it just completely water soluble by means of one or more solubilizing couplers. It has also been found that the addition of an excess of a solubilizing coupler in an amount exceeding approximately twenty-five percent more than that minimally required to completely solubilize the sparingly soluble organic solvent lowers or detracts from the degreasing efficacy of the degreaser compositions as experimentally demonstrated hereinafter. With respect to the organic solvent component of the degreaser compositions of the invention, optimum degreasing efficacy is achieved by utilizing organic solvents which have limited water solubility in the range of approximately 0.2 to approximately 6 weight percent of the total composition, organic solvents with water solubilities outside this range appearing to provide less effective degreasing action.

The solubilizing couplers or hydrotopes which are useful in the practice of the present invention are those couplers or hydrotropes which have a surface tension in excess of approximately 45 dynes/cm (at concentrations of approximately 0.01–1.0%) and which generally have a hydrophobe chain length in the range $C_4$ to $C_{10}$. It is generally recognized that, at concentrations of approximately 0.01–1.0%, nearly all detergent type surfactants (of all ionic classes) have surface tensions typically falling between 28 to 35 dynes/cm and hydrophobe chain lengths falling within the $C_{10}$ to $C_{18}$ range, with $C_{12}$ to $C_{14}$ being considered optimum. On the other hand, the solubilizing couplers or hydrotropes useful in the present invention, because of their shorter $C_4$ to $C_{10}$ chain length, exhibit aqueous surface tensions in excess of approximately 45 dynes/cm (at concentrations of approximately 0.01–1.0%), sometimes even approaching that of water (72 dynes/cm). Such solubilizing couplers are characterized by a stronger hydrophilicity and a weaker hydrophobicity than that exhibited by surfactants and function in the present invention to just solubilize the aqueous insoluble or sparingly water soluble solvent to produce a totally water soluble degreaser composition in which the degreasing efficacy of the solvent, because of its preponderant oleophilic and hydrophobic nature, is maximized. Improved decreasing efficacy is realized when the amount of solubilizing coupler in the degreaser compositions does not substantially exceed that required to completely solubilize the organic solvent or when the amount of coupler does not substantially exceed twenty-five percent more than that required to completely solubilize the organic solvent. The resulting degreaser compositions of the invention are advantageously less combustible, less costly and generally less toxicologically hazardous than available and conventional degreasing water insoluble solvents or aqueous emulsions.

The following is a list of exemplary solubilizing couplers for use in the present invention together with their respective surface tensions (in $H_2O$ at 25° C.) at the concentrations and source of supply indicated:

| Coupler | Conc. % | Surface Tension Dynes/Cm. |
|---|---|---|
| Sodium xylene sulfonate (Witco) | 1.0 | 55 |
| | 0.25 | 68 |
| | 0.1 | 70 |
| Sodium 2-ethylhexyl sulfate (Niaproof 08, Niacet Corp.) | 0.1 | 63 |
| Sodium octane-1-sulfonate (BioTerge PAS-8S, Stepan) | 0.1 | 52 |
| Sodium butoxyethoxy acetate (Mirawet B, Miranol Co.) | 1.0 | 51.5 |
| Sodium pelargonate (Monatrope 1250, Mona) | 0.01 | 67.8 |
| Sodium condensed naphthalene-sulfonic acid (Tamol SN, Rohm & Haas) | 1.0 | 71 |
| Sodium (lower) alkyl-naphthalene sulfonate (Petro AA, DeSoto) | 0.1 | 58 |
| Sodium toluene sulfonate (Witco) | 0.1 | 71 |
| Sodium diisobutyl sulfosuccinate (Monawet (MB45) Mona) | 0.1 | 54 |
| Sodium cumene sulfonate | 0.02 | 64 |

It will be understood that other solubilizing couplers having aqueous surface tension exceeding approximately 45 dynes/cm (at concentrations of approximately 0.01–1.0%) and known to those in the art may be used in the practice of the invention. Additional solubilizing couplers which may be used include sodium benzene sulfonate, potassium ethylbenzene sulfonate, potassium dimethylnaphthalene sulfonate, ammonium xylene sulfonate, sodium diphenyoxide disulfonate, ammonium n-butoxyethyl sulfate, sodium 2-ethylhexanoate, sodium n-butoxymethyl carboxylate, potassium mono/di phenoxyethyl phosphate, sodium mono/di n-butoxyethyl phosphate, triethanolamine trimethylolpropane phosphate, sodium amyloamphoproprionate, disodium capryloiminodipropionate, and sodium butryo imidazoline amphoglycinate.

The principal classes of organic solvents from which useful organic solvents may be selected include esters, alcohols, ketones, aldehydes, ethers, and nitriles. These will generally contain one or more of the desired similar or dissimilar functional groups listed above. Examples of organic solvents containing similar functional groups from among those listed above include diethyl gluterate (2 ester groups), phenacyl acetone (2 keto groups), diethylethylene diphosphonate (2 phosphonate ester groups), ethylenedipropionate (2 ester groups), decylene glycol (2 hydroxyl groups), m-dimethoxybenzene (2 ether groups), adiponitrile (2 nitrile groups), ethylene glycol dibutyl ether (2 ether groups), and diethyl-o-phthalate (2 ester groups). Among organic solvents containing dissimilar functional groups from among those listed above may be mentioned 2-phenoxyethanol (hydroxy, ether groups), 1-phenoxy-2-propanol(hydroxy, ether groups), N-phenylmorpholine(amino, ether groups), isopropylaceacetate (keto, ester groups), o-methoxybenzyl alcohol (ether, hydroxy groups), 4'-methoxyacetophenone (ether, ketone groups), o-nitrophenetole (nitro, ether groups), 2-hexoxyethanol (hydroxy, ether groups), ethylcyanoacetoacetate (cyano, keto, ester groups), p-anisaldehyde (ether, aldehyde groups), polypropylene glycol 1200 (ether, hydroxyl groups), n-butoxy acetate (ether, ester groups), and 2-phenylthioethanol (thioether, hydroxyl groups).

In addition to the criteria listed above, it is also desirable but not essential that the organic solvent have a relatively low volatility or high flash point (in excess of 60° C.) exhibit a low level of odor, be chemically stable, nontoxic, nonhazardous and commercially available.

The sparingly water soluble organic solvents which may be employed in the practice of the present invention (and comprising some of the solvents listed above) together with their aqueous ambient temperature solubility in wt.% include 2-phenoxyethanol (2.3) (marketed under the trade designation "Dowanol EPh"), 1-phenoxy-2-propanol (1.1) (marketed under the trade designation "Dowanol PPh"), dipropylene glycol mono-n-butyl ether (5.0) (marketed under the trade designation "Dowanol DPnB") 8-phenylethanol (1.6), acetophenone (0.5), benzyl alcohol (4.4), benzonitrile (1.0), n-butyl acetate (0.7), n-amyl acetate (0.25), benzaldehyde (0.3), N,N-diethylaniline (1.4), diethyl adipiate (0.43), dimethyl-o-phthalate (0.43), n-amyl alcohol (2.7), N-phenylmorpholine (1.0), n-butoxyethyl acetate (EB acetate) (1.1), cyclohexanol (4.2), polypropylene glycol 1200 (2), cyclohexanone (2.3), isophorone (1.2), methylisobutyl ketone (2.0), methylisoamyl ketone (0.5), tri-n-butylphosphate (0.6), 1-nitropropane (1.4), nitroethane (4.5), dimethyl esters of mixed succinic, glutaric and adipic acids (5.7) (marketed under the trade designation "DBE ester" by DuPont), diethyl glutarate (0.88), and diethyl malonate (2.08). As will be apparent to those skilled in the art, the above-listed sparingly water soluble organic solvents are merely illustrative and various other solvents meeting the criteria set out above may also be utilized in the practice of the invention. Because of their performance characteristics, lack of odor, low volatility/high flash point, chemical stability and availability, 2-phenoxyethanol, 1-phenoxy-2-propanol and dipropylene glycol mono-n-butyl ether are the preferred organic solvents of choice. N-butoxyethyl acetate (EB acetate) and the dimethyl esters of mixed succinic, glutaric and adipic acids are also among the preferred organic solvents.

As indicated, a number of otherwise potent organic solvents having an aqueous solubility of less than approximately 0.2 weight percent such as 2-(2-ethylhexoxy)ethanol (2-ethylhexyl cellosolve) having an aqueous solubility of only 0.095 wt.% and 2,6-dimethyl-4-heptanone (diisobutyl ketone) (aq. sol. 0.05 wt.%), and organic solvents having an aqueous solubility in excess of approximately 6 weight percent such as propylene glycol monomethyl ether acetate (aq. sol. 16.5 wt.%), ethylene glycol diacetate (aq. sol. 14.3 wt.%), propylene carbonate (aq. sol. 19.6 wt.%) and N-methyl pyrrolidone (infinite aq. sol.) are not useful in the practice of the invention.

In formulating the stable, aqueous degreaser compositions of the invention, an organic solvent meeting the required criteria is combined with a solubilizing coupler of the type previously described and water. The solubilizing coupler as previously indicated is present in the formulated composition in an amount not substantially exceeding that required to completely solubilize the particular organic solvent being used, i.e., a minimum level of the solubilizing coupler is used in order to render the organic solvent "barely soluble" in the aqueous solution so as to achieve maximum degreasing action. The amount of solubilizing coupler required to achieve this objective will vary depending upon the particular organic solvent employed and can readily be determined by simple experimentation in each instance. Also, as previously described use-ful results are also obtainable by employing up to and not more than an amount substantially exceeding twenty-five percent more than that minimally required to render the organic solvent "barely soluble". Thus, in order to obtain optimum or acceptable results, the solubilizing coupler is present in the minimum amount or up to twenty-five percent more than the minimum amount necessary to just solubilize the organic solvent. As the amount of solubilizing coupler increases beyond the twenty-five percent excess amount required to completely solubilize the organic solvent, the degreasing efficacy of the composition tends to decrease.

It will be understood that in preparing the degreaser compositions of the invention, a mixture of the above-described solubilizing couplers may be employed in lieu of a single solubilizing coupler. Similarly, but less preferably, a mixture of the sparingly soluble organic solvents may be employed in formulating the compositions of the invention. However, if a mixture of solvents is to be used, each of the solvents should have nearly the same approximate water solubility so that they will solubilize in water at approximately the same point upon addition of the solubilizing coupler. The components comprising the compositions of the invention may generally be brought together in any prescribed order under conventional mixing conditions at ambient temperatures.

In addition to the organic solvent and solubilizing additive components of the compositions of the invention, various optional adjuvants can be incorporated. These include among other adjuvants chelants such as the sodium salts of ethylenediaminetetraacetic acid (Hampene 100 or Versene 100), builders, thickeners such as carboxy acrylic polymers (Carbopol 940) or acrylic acid/alkyl methacrylate copolymers (Acrysol ICS-1), fragrances, dyes, pH adjustants, anti-corrosion additives and anti-rust additives. In general, it is preferred that the compositions be formulated to have a pH of about 7.0 so as to be gentle to the hands and avoid defatting the skin.

The concentration of the aqueous degreaser solution, as indicated by the terms "total solids content" and "total actives content" in the working examples provided hereinafter refers, respectively, to the combined percentages of nonvolatile components and to the sum total of nonaqueous volatile and nonvolatile components.

The term "cloud point" indicates the temperature below which the composition exists as a clear, single phase solution and above which phase separation (heterogeneity) occurs. For practical reasons, a composition should preferably have a cloud point in excess of, for example 50° C., to have a viably safe, storage-stable shelf life under hot, summertime warehouse conditions.

It is to be expected that, as the concentration of a given organic solvent is increased (with necessary concomitant increase in solubilizing coupler), the rate at which degreasing is accomplished likewise increases and improved degreasing efficacy can be realized. Conversely, as the organic solvent concentration is lowered, either by diluting a given composition with water or through changes made in formulating the degreaser composition, the degreasing rate is generally lowered and efficacy can be said to diminish or lessen. Thus, the concentration, as measured by "total solids content" and "total actives content" can be adjusted to any given or desired level within the parameters, criteria, and constraints imposed on the practice of the invention, and within the normal, viable operational limits encountered in formulating the components of said compositions. Thus, it is possible to formulate water soluble solution concentrates provided enough solubilizing coupler is used to completely solubilize the organic solvent, and that upon dilution, the degreasing efficacy is only gradually diminished by reason of the larger volume of water present.

The following examples illustrate the practice of the invention.

EXAMPLE 1

In the following examples of illustrative degreaser compositions of the present invention, the compositions were subjected as indicated to the definitive, semiquantitative degreasing test method described below in order to measure their degreasing efficacy.

A magnetic stirrer (Fisher Scientific Co., Catalog No. 14-511-1A) provided with a vaned disc magnetic stir bar (7/8" (diameter)×5/8" (height), 22 mm×15 mm, Fisher Scientific Co., Catalog No. 14,511-98C.) was used. In each instance, pre-cleaned, borosilicate glass microslides (3"× 1", 1.0 mm thickness) were thinly smeared/rub-on coated with Vaseline brand white petroleum jelly on one side only to a distance of 1.0" from the bottom edge to provide a 1.0"×1.0" coated area. The test degreaser solutions were employed at full strength unless otherwise indicated and in an amount sufficient to fill a 50 ml. Pyrex beaker containing the vaned disc magnetic stirrer bar to a level of 40 ml. Each test solution and surrounding air were maintained at 21±0.5° C. and the test solution stirring rate was determined by a setting of "3" on the stirrer dial of the magnetic stirrer. The stirring disc was positioned off-center to accomodate each microslide, touching neither the beaker walls nor the microslide and rotating freely when in use. The microslide, in each test, rested upright on the beaker bottom, was allowed to lean against the lip of the beaker at an approximately 75° angle and was positioned with the Vaseline coated face or area facing upward away from the vaned disc magnetic stirrer bar.

For each test, the beaker containing the stirrer bar was filled to 40 ml. with the test degreasing solution at the indicated concentration, placed atop the magnetic stirrer plate, and positioned off-center to accomodate the glass microslide, and yet allow the vaned disc stirrer bar to rotate or spin freely. The stirrer was turned on, the dial adjusted manually to the "3" stirring rate setting and the Vaseline thin film coated glass microslide was introduced into the test solution bath in such a manner that the coated side faced upward and was positioned away from the stirrer bar. The time "0" was noted immediately on a watch or clock with a sweep second hand.

At appropriate time intervals, the glass microslide was briefly removed from the degreaser solution bath and immediately "read" for "% Vaseline removed from the 1.0" × 1.0" treated area", an objective determination, after which the microslide was immediately returned to a stirred aqueous degreaser bath. The duration of the degreasing test is determined by the time needed for complete, 100% removal of the Vaseline film from the glass microslide surface.

The accuracy of the above-described test method is of the order of a ±5% as determined by replicate run averaging.

EXAMPLE 2

An aqueous degreaser formulation was prepared having the following composition:

| Component | Wt. % |
|---|---|
| 2-Phenoxyethanol (Dowanol EPh) | 4.0 |
| Sodium cumene sulfonate (45%) | 5.5 |
| Soft $H_2O$ | 90.5 |
| | 100.0 |

The composition was a clear aqueous solution having a pH of 6.70, a total solids content (theory) of 2.48%, a total actives content (theory) of 6.48%, a cloud point in excess of 100° C., and no flash point.

The composition readily, completely, and easily removed the following markings from alkyd enameled metal surfaces: black, indelible Magic Marker felt pen, blue and black indelible ballpoint pen, #1 hardness pencil, and red (wax) crayon.

The composition was subjected to the degreasing test method of Example 1 with the following results:
1st attack on greased slide at 7 sec.
20–25% removal of grease at 30 sec.
70% removal of grease at 1.0 min.
90% removal of grease at 1.5 min.
100% removal of grease at 1.75 min.

It was determined that in this composition the amount of sodium cumene sulfonate incorporated was just barely in excess of that required to completely solubilize the 2-phenoxyethanol and form an aqueous solution.

EXAMPLE 3

An aqueous degreaser formulation was prepared having the following composition:

| Component | Wt. % |
|---|---|
| 2-Phenoxyethanol (Dowanol EPh) | 4.0 |
| Sodium octane-1-sulfonate (BioTerge PAS-8S, 40%) | 5.1 |
| Soft $H_2O$ | 90.9 |
| | 100.0 |

The composition was a clear, colorless, aqueous solution having a pH of 3.50 (which was adjusted to a pH of 7.0 with the addition of approximately five drops of 0.1NaOH), a total solids content (theory) of 2.04%, a total actives content (theory) of 6.04%, a cloud point in excess of 100° C., and no flash point.

The composition fully and easily removed the same markings listed in Example 2 from alkyd enameled metal surfaces.

The composition was subjected to the degreasing test method of Example 1 with the following results:
1st attack on greased slide at 8–9 sec.
15–20% removal of grease at 30 sec.
50% removal of grease at 1.0 min.
75% removal of grease at 1.5 min.
90% removal of grease at 2.0 min.
100% removal of grease at 2.5 min.

EXAMPLE 4

An aqueous degreaser formulation was prepared having the following composition:

| Component | Wt. % |
|---|---|
| 1-Phenoxy-2-propanol (Dowanol PPh) | 4.0 |
| Sodium 2-ethylhexyl sulfate (Niaproof 08, 40%) | 8.5 |
| Soft $H_2O$ | 87.5 |
| | 100.0 |

The composition was a clear, colorless, aqueous solution having a pH of 9.97, a total solids content (theory) of 3.4%, a total actives content (theory) of 7.4%, a cloud point of 43° C., and no flash point.

The composition totally and quickly removed the same markings listed in Example 2 from alkyd enameled metal surfaces.

The composition was subjected to the degreasing test method of Example 1 with the following results:
1st attack on greased slide at 5 sec.
5–30% removal of grease at 30 sec.
5% removal of grease at 1 min.
0% removal of grease at 1.25 min.
100% removal of grease at 1.5 min.

EXAMPLE 5

An aqueous degreaser formulation was prepared having the following composition:

| Component | Wt. % |
|---|---|
| Benzyl alcohol | 5.0 |
| Sodium xylene sulfonate, 40% | 11.0 |
| Soft $H_2O$ | 84.0 |
| | 100.0 |

The composition was a clear, essentially colorless, aqueous solution having a pH of 7.85, a total solids content (theory) of 4.4%, a total actives content (theory) of 9.4%, and a cloud point in excess of 100° C.

The composition totally and easily removed the same markings listed in Example 2 from alkyd enameled metal surfaces.

The composition was subjected to the degreasing test method of Example 1 with the following results:
1st attack on greased slide at 5 sec.
5% removal of grease at 30 sec.
0% removal of grease at 1.0 min.
5% removal of grease at 1.5 min.
100% removal of grease at 2.25 min.

EXAMPLE 6

An aqueous degreaser formulation was prepared having the following composition:

| Component | Wt. % |
|---|---|
| Acetophenone | 1.0 |
| Sodium 2-ethylhexyl sulfate, 40% | 10.0 |
| Soft $H_2O$ | 89.0 |
| | 100.0 |

The composition was a clear, essentially colorless, aqueous solution having a pH of 10.02, a total solids content (theory) of 4.0%, a total actives content (theory) of 5.0%, a cloud point in excess of 100° C., and no flash point.

The composition readily and completely removed the following markings from alkyd enameled metal surfaces: black, indelible Magic Marker felt pen, blue and black indelible ballpoint pen, and red (wax) crayon. The composition partially (40–50%) removed #1 hardness pencil markings from such surfaces.

The composition was subjected to the degreasing test method of Example 1 with the following results:
1st attack on greased slide at 1–2 sec.
3% removal of grease at 15 sec.
5% removal of grease at 30 sec.
100% removal of grease at 1 min, 10 sec.

EXAMPLE 7

An aqueous degreaser formulation was prepared having the following composition:

| Component | Wt. % |
|---|---|
| 2-Phenoxyethanol (Dowanol EPh) | 4.0 |
| Potassium salt, phosphate ester (Triton H-66, 50% assay) | 8.5 |
| Soft $H_2O$ | 87.5 |
| | 100.0 |

The composition was a clear, very pale yellow, aqueous solution having a pH of 7.79, a total solids content (theory) of 4.25% a total actives content (theory) of 8.25%, a cloud point in excess of 100° C., and no flash point.

The composition readily, easily and completely removed the same markings listed in Example 2 from alkyd enameled metal surfaces.

The composition was subjected to the degreasing test method of Example 1 with the following results:
1st attack on greased slide at 6 sec.
5% removal of grease at 30 sec.
5–70% removal of grease at 1.0 min.
90–95% removal of grease at 1.5 min.
100% removal of grease at 2.0 min.

EXAMPLE 8

An aqueous degreaser formulation was prepared having the following composition:

| Component | Wt. % |
|---|---|
| 2-Phenoxyethanol (Dowanol EPh) | 4.0 |
| Sodium pelargonate, 45% (Monatrope 1250) | 7.5 |
| Soft $H_2O$ | 88.5 |
| | 100.0 |

The composition was a clear, essentially colorless, aqueous solution having a pH of 8.81, a total solids content (theory) of 3,38%, a total actives content (theory) of 7.38%, a cloud point in excess of 100° C., and no flash point.

The composition readily and completely removed the same markings listed in Example 2 from alkyd enameled metal surfaces.

The composition was subjected to the degreasing test method of Example 1 with the following results:
1st attack on greased slide at 6 sec.
25% removal of grease at 30 sec.
70% removal of grease at 1.0 min.
85–90% removal of grease at 1.5 min.
100% removal of grease at 2.0 min.

EXAMPLE 9

An aqueous solution of a highly water soluble organic solvent was prepared having the following composition (corresponding to the composition of Example 2 except for the organic solvent component):

| Component | Wt. % |
|---|---|
| Ethylene glycol monobutyl ether (Butyl Cellosolve) | 4.0 |
| Sodium cumene sulfonate, 45% | 5.5 |
| Soft $H_2O$ | 90.5 |
| | 100.0 |

The composition was a clear, colorless, aqueous solution having a pH of 6.84, a total solids content (theory) of 2.48%, a total actives content (theory) of 6.48%, a cloud point in excess of 100° C., and a flash point in excess of 150° C.

The composition totally failed to remove the markings listed in Example 2 from alkyd enameled metal surfaces.

The composition was subjected to the degreasing test method of Example 1 with the following results:
1st attack on greased slide at 25 sec.
10% removal of grease at 1.0 min.
15–20% removal of grease at 2.0 min.
30% removal of grease at 3.0 min.
45–50% removal of grease at 4.0 min.
60% removal of grease at 6.0 min.
75% removal of grease at 9.0 min.
80–85% removal of grease at 12.0 min.
90% removal of grease at 15.0 min.
100% removal of grease at 18.5 min.

EXAMPLE 10

An aqueous solution of a highly water soluble organic solvent was prepared having the following composition (corresponding to the composition of Example 3 except for the organic solvent component):

| Component | Wt. % |
|---|---|
| Ethylene glycol monobutyl ether (Butyl Cellosolve) | 4.0 |
| Sodium octane-1-sulfonate (BioTerge PAS-8S 40%) | 5.1 |
| Soft $H_2O$ | 90.9 |
| | 100.0 |

The composition was a clear, colorless, aqueous solution having a pH of 7.03 (adjusted to this pH by dropwise addition 0.1N NaOH), a total solids content (theory) of 2.04%, a total actives content (theory) of 6.04%), a cloud point in excess of 100° C., and a flash point in excess of 150° C.

The composition totally failed to remove the markings listed in Example 2 from alkyd enameled metal surfaces.

The composition was subjected to the degreasing test method of Example 1 with the following results:

1st attack on greased slide at 20 sec.
<5% removal of grease at 30 sec.
10–15% removal of grease at 1.0 min.
25–30% removal of grease at 3.0 min.
40% removal of grease at 5.0 min.
50% removal of grease at 8.0 min.
60–65% removal of grease at 11.0 min.
70–75% removal of grease at 14.0 min.
80% removal of grease at 18.0 min.
90% removal of grease at 22.0 min.
100% removal of grease at 26.0 min.

EXAMPLE 11

An aqueous degreaser formulation in the form of an aqueous solution concentrate was prepared having the following composition:

| Component | Wt. % |
|---|---|
| 2-Phenoxyethanol (Dowanol EPh) | 20.0 |
| Sodium cumene sulfonate, 45% | 15.0 |
| Soft $H_2O$ | 65.0 |
| | 100.0 |

The concentrate composition was a very clear, colorless, aqueous solution having a pH of 8.07, a total solids content (theory) of 6.75%, a total actives content (theory) of a cloud point in excess of 100° C., and no flash point.

Upon a 1:5 dilution with water, an emulsion formed which very easily and totally removed the markings listed in Example 2 from alkyd enameled metal surfaces.

The emulsion resulting from the 1:5 dilution with water was subjected to the degreasing test method of Example 1 with the following results:

1st attack on greased slide at 1 sec.
45% removal of grease at 10 sec.
80–85% removal of grease at 20 sec.
100% removal of grease at 25 sec.

Upon a 1:10 dilution of the composition with water, a very faint, hazy emulsion (almost a solution) was formed which was subjected to the degreasing test method of Example 1 with the following results:

1st attack on greased slide at 2–3 sec.
20% removal of grease at 1.5 sec.
55% removal of grease at 30 sec.
75% removal of grease at 45 sec.
85–90% removal of grease at 1.0 min.
100% removal of grease at 1.5 min.

EXAMPLE 12

An aqueous degreaser aerosol formulation was prepared having the following composition:

| Component | Wt. % |
|---|---|
| 2-Phenoxyethanol (Dowanol EPh) | 3.0 |
| Sodium pelargonate, 45% (Monatrope 1250) | 7.0 |
| Sodium nitrite | 0.2 |
| Ammonium hydroxide (28% $NH_3$) | 0.05 |
| Deionized $H_2O$ | 89.75 |
| | 100.00 |

The composition was a clear, colorless, aqueous solution having a pH of 10.15.

The above composition was aerosolized in a 6 oz. aerosol can using 8.32 g (15.0 ml.) of a propane-isobutane blend propellant (sold under the trade designation A-55) introduced under nitrogen gas pressure through a crimped-on AR-75 valve. The fill ratio equaled 87/13. The valve was fitted with a Marc-18-1525 actuator.

It was found that the resulting aerosol formulation very easily and fully removed the markings listed in Example 2 from alkyd enameled metal surfaces and also easily removed automotive grease smearings.

Examples 2, 13, 14, and 15 represent a series of formulations in which the level of solubilizing coupler, sodium cumene sulfonate, is increased from 104 to 208% of the minimum level of coupler required to fully solubilize the 2-phenoxyethanol solvent.

EXAMPLE 13

An aqueous degreaser formulation was prepared having the following composition:

| Component | Wt. % |
|---|---|
| 2-Phenoxyethanol (Dowanol EPh) | 4.0 |
| Sodium cumene sulfonate (45%) | 6.5 |
| Soft $H_2O$ | 89.5 |
| | 100.0 |

The amount of solubilizing coupler present was 123% of the minimum amount (5.3 wt%) required to fully solubilize the 2-phenoxyethanol solvent. The composition was a clear, colorless aqueous solution having a pH of 7.08, a total solids content (theory) of 2.93%, a total actives content (theory) of 6.93%, a cloud point in excess of 100° C., and no flash point.

The composition removed the following markings from alkyd enameled metal surfaces with comparative ease:

black, indelible Magic Marker felt pen ≧95%
blue, indelible ballpoint pen 100%
black, indelible ballpoint pen 90–95% red (wax) crayon 95%
#1 hardness pencil 100%

The composition was subjected to the degreasing test method of Example 1 with the following results:
1st attack on greased slide at 15 sec.
5-10% removal of grease at 30 sec.
20% removal of grease at 1.0 min.
35-40% removal of grease at 1.5 min.
50% removal of grease at 2.0 min.
60-65% removal of grease at 2.5 min.
75% removal of grease at 3.0 min.
80-85% removal of grease at 3.5 min.
90% removal of grease at 4.0 min.
100% removal of grease at 4.5 min.

EXAMPLE 14

Example 13 was repeated in preparing a formulation having the following composition:

| Component | Wt. % |
|---|---|
| 2-Phenoxyethanol (Dowanol EPh) | 4.0 |
| Sodium cumene sulfonate (45%) | 8.0 |
| Soft $H_2O$ | 88.0 |
| | 100.0 |

The amount of solubilizing coupler present was 151% of the minimum amount required to fully solubilize the 2-phenoxyethanol solvent. The composition was an aqueous solution having a pH of 7.11, a total solids content (theory) of 3.60%, a total actives content (theory) of 7.60%, a cloud point in excess of 100° C., and no flash point.

The composition removed the following markings from alkyd enameled metal surfaces as indicated:
black, indelible Magic Marker felt pen 70%
blue, indelible ballpoint pen 95%
black, indelible ballpoint pen 35-40%
red (wax) crayon 60% #1 hardness pencil 95%

The composition was subjected to the degreasing test method of Example 1 with the following results:
1st attack on greased slide t 40 sec.
10-15% removal of grease at 2.0 min.
20% removal of grease at 4.0 min.
25-30% removal of grease at 70 min.
35% removal of grease at 10.0 min.
50% removal of grease at 15.0 min.
65% removal of grease at 20.0 min.
75-80% removal of grease at 25.0 min.
90% removal of grease at 30.0 min.
100% removal of grease at 35.0 min.

EXAMPLE 15

Example 13 was repeated in preparing a formulation having the following composition:

| Component | Wt. % |
|---|---|
| 2-Phenoxyethanol (Dowanol EPh) | 4.0 |
| Sodium cumene sulfonate (45%) | 11.0 |
| Soft $H_2O$ | 85.0 |
| | 100.0 |

The amount of solubilizing coupler present was 208% of the minimum amount required to fully solubilize the 2-phenoxyethanol solvent. The composition was a clear, colorless, aqueous solution with very slight transient foaming characteristics. The composition had a pH of 7.19, a total solids content (theory) of 4.95%, a total actives content (theory) of 8.95%, a cloud point in excess of 100° C., and no flash point.

The composition removed with great difficulty the following markings from alkyd enameled metal surfaces as indicated:
black, indelible Magic Marker felt pen 30%
blue, indelible ballpoint pen 80%
black, indelible ballpoint pen 10%
red (wax) crayon 40%
#1 hardness pencil 95%

The composition was subjected to the degreasing test method of Example 1 with the following results:
1st attack on greased slide at 2.0 min.
10% removal of grease at 3.0 min.
10-15% removal of grease at 5.0 min.
15-20% removal of grease at 7.0 min.
25% removal of grease at 10 min.
30% removal of grease at 15 min.
40-45% removal of grease at 30 min.
55-60% removal of grease at 1.0 hr.
65% removal of grease at 1.5 hr.
70-75% removal of grease at 2.0 hrs.
80% removal of grease at 3.0 hrs.
90% removal of grease at 4.0 hrs.
100% removal of grease at 5.5 hrs.

Examples 16-19 comprise a series of formulations in which the level of solubilizing coupler is increased from 100% to 200% of that amount required to fully solubilize the sparingly soluble solvent.

EXAMPLE 16

An aqueous degreaser formulation was prepared having the following composition:

| Component | Wt. % |
|---|---|
| Benzyl alcohol | 5.0 |
| Sodium octane-1-sulfonate (BioTerge PAS-8S, 40%) | 4.8 |
| Soft $H_2O$ | 90.2 |
| | 100.0 |

The amount of solubilizing coupler present was the minimum amount which fully solubilized the benzyl alcohol solvent. The composition was a clear, colorless, aqueous solution having an adjusted pH of 7.0, a total solids content (theory) of 1.92%, a total actives content (theory) of 6.92%, a cloud point in excess of 100° C., and no flash point.

The composition totally and very easily removed the same markings listed in Example 2 from alkyd enameled metal surfaces.

The composition was subjected to the degreasing test method of Example 1 with the following results:
1st attack on greased slide at 3 sec.
40% removal of grease at 15 sec.
70% removal of grease at 30 sec.
100% removal of grease at 45 sec.

EXAMPLE 17

An aqueous degreaser formulation was prepared having the following composition:

| Component | Wt. % |
|---|---|
| Benzyl alcohol | 5.0 |
| Sodium octane-1-sulfonate (BioTerge PAS-8S, 40%) | 6.0 |
| Soft $H_2O$ | 89.0 |
| | 100.0 |

The amount of solubilizing coupler present was 125% of the minimum amount required to fully solubilize the benzyl alcohol solvent. The composition was a clear, colorless, aqueous solution having an adjusted pH of 7.0, a total solids content (theory) of 2.40%, a total actives content (theory) of 7.40%, a cloud point in excess of 100° C., and no flash point.

The composition removed the following markings from alkyd enameled metal surfaces as indicated:
black, indelible Magic Marker felt pen 95%
blue, indelible ballpoint pen 100%
black, indelible ballpoint pen 95%
red (wax) crayon 90%
#1 hardness pencil 75%

The composition was subjected to the degreasing test method of Example 1 with the following results:
1st attack on greased slide at 10 sec.
5–10% removal of grease at 15 sec.
25% removal of grease at 30 sec.
50% removal of grease at 1.0 min.
65–70% removal of grease at 1.5 min.
80% removal of grease at 2.0 min.
90% removal of grease at 2.5 min.
100% removal of grease at 3.0 min.

EXAMPLE 18

Examples 16 and 17 were repeated in preparing a formulation having the following composition:

| Component | Wt. % |
|---|---|
| Benzyl alcohol | 5.0 |
| Sodium octane-1-sulfonate (BioTerge PAS-8S, 40%) | 7.5 |
| Soft $H_2O$ | 87.5 |
| | 100.0 |

The amount of solubilizing coupler present was 156% of the minimum amount required to fully solubilize the benzyl alcohol solvent. The composition was a clear, colorless, aqueous solution having an adjusted pH of 7.0, a total solids content (theory) of 3.00%, a total actives content (theory) of 8.00%, a cloud point in excess of 100° C., and no flash point.

The composition removed the following markings from alkyd enameled metal surfaces as indicated:
black, indelible Magic Marker felt pen 60%
blue, indelible ballpoint pen 95%
black, indelible ballpoint pen 65–70%
red (wax) crayon 70%
#1 hardness pencil 45%

The composition was subjected to the degreasing test method of Example 1 with the following results:
1st attack on greased slide at 20 sec.
15% removal of grease at 1.5 min.
25–30% removal of grease at 5.0 min.
45% removal of grease at 10.0 min.
60% removal of grease at 15.0 min.
70–75% removal of grease at 20.0 min.
90% removal of grease at 30.0 min.
95% removal of grease at 35.0 min.
100% removal of grease at 40.0 min.

EXAMPLE 19

Examples 16, 17, and 18 were repeated in preparing a formulation having the following composition:

| Component | Wt. % |
|---|---|
| Benzyl alcohol | 5.0 |
| Sodium octane-1-sulfonate (BioTerge PAS-8S, 40%) | 9.6 |
| Soft $H_2O$ | 85.4 |
| | 100.0 |

The amount of solubilizing coupler present was twice the minimum amount which fully solubilized the benzyl alcohol solvent. The composition was a clear, colorless, aqueous solution having an adjusted pH of 7.0, a total solids content (theory) of 3.84%, a total actives content (theory) of 8.84%, a cloud point in excess of 100° C., and no flash point.

The composition removed the following markings from alkyd enameled metal surfaces as indicated:
black, indelible Magic Marker felt pen 35%
blue, indelible ballpoint pen 90%
black, indelible ballpoint pen 20%
red (wax) crayon 40%
1 hardness pencil 30%

The composition was subjected to the degreasing test method of Example 1 with the following results:
1st attack on greased slide at 40 sec.
10% removal of grease at 1.5 min.
15% removal of grease at 3.0 min.
15–20% removal of grease at 5.0 min.
25% removal of grease at 10.0 min.
30% removal of grease at 15.0 min.
35–40% removal of grease at 25.0 min.
50% removal of grease at 40.0 min.
60–75% removal of grease at 1.0 hr.
70% removal of grease at 1.5 hr.
75–80% removal of grease at 2.0 hr.
90% removal of grease at 3.0 hr.
100% removal of grease at 4.0 hr.

In view of the above, it will be seen that the several objects of the invention are achieved and other advantageous results attained.

As various changes could be made in the above compositions and methods without departing from the scope of the invention, it is intended that all matter contained in the above description shall be interpreted as illustrative and not in a limiting sense.

What is claimed is:

1. A stable, aqueous degreaser composition in the form of a totally water soluble solution comprising at least one sparingly water soluble organic solvent, an organic solubilizing coupler and water and being free from foaming surfactants;

(a) said sparingly water soluble organic solvent being characterized by:
  (i) having a water solubility in the range of approximately 0.2 to approximately 6 weight percent;
  (ii) not being a hydrocarbon or halocarbon;
  (iii) having one or more similar or dissimilar oxygen, nitrogen, sulfur, or phosphorous containing functional groups;
  (iv) being a solvent for hydrophobic soilants; and (v) being present in an amount exceeding its aqueous solubility in the absence of a solubilizing coupler; and;

(b) said solubilizing coupler being an organic solubilizing coupler having a hydroprobe chain length in the range of $C_4$ to $C_{10}$ and an aqueous surface tension in excess of approximately 45 dynes/cm (at concentrations of approximately 0.01–1.0%) and being present in an amount not substantially exceeding twenty-five percent more than the minimum amount required to completely solubilize said organic solvent.

2. A stable, aqueous degreaser composition as set forth in claim 1 wherein water solubilizing coupler is present in an amount not substantially exceeding that minimally required to completely solubilize said organic solvent.

3. A stable, aqueous degreaser composition as set forth in claim 1 wherein said organic solvent has a water solubility in the range of approximately 1 to approximately 2.5 weight percent.

4. A stable, aqueous degreaser composition as set forth in claim 1 wherein said organic solvent is selected from the group consisting of esters, alcohols, ketones, aldehydes, ethers, and nitriles.

5. A stable, aqueous degreaser composition as set forth in claim 1 wherein said organic solvent is further characterized by having a high flash point in excess of 60° C.

6. A stable, aqueous degreaser composition as set forth in claim 1 wherein said solvent is selected from the group consisting of 2-phenoxyethanol, 1-phenoxy-2-propanol, dipropylene glycol mono-n-butyl ether, β-phenylethanol, acetophenone, benzyl alcohol, butoxyethyl acetate, isophorone, and the dimethyl esters of mixed succinic, glutaric, and adipic acids.

7. A stable, aqueous degreaser composition as set forth in claim 1 wherein said solubilizing coupler is selected from the group consisting of sodium cumene sulfonate, sodium xylene sulfonate, sodium 2-ethylhexyl sulfate, sodium octane-1-sulfonate, sodium butoxyethoxy acetate, sodium pelargonate, sodium condensed naphthalenesulfonic acid, sodium (lower) alkylnaphthalene sulfonate, sodium toluene sulfonate, sodium diisobutyl sulfosuccinate, sodium benzene sulfonate, potassium ethylbenzene sulfonate, potassium dimethylnaphthalene sulfonate, ammonium xylene sulfonate, sodium diphenyoxide disulfonate, ammonium n-butoxyethyl sulfate, sodium 2-ethylhexanoate, sodium n-butoxymethyl carboxylate, potassium mono/di phenoxyethyl phosphate, sodium mono/di n-butoxyethyl phosphate, triethanolamine trimethylolpropane phosphate, sodium amyloamphoproprionate, disodium capryloiminodipropionate, and sodium butryo imidazoline amphoglycinate.

8. A stable, aqueous degreaser composition as set forth in claim 1 wherein said water soluble solution additionally comprises one or more optional adjuvants selected from the group consisting of chelants, thickeners, builders, fragrances, dyes, pH adjustants, anti-corrosion additives, and anti-rust additives.

9. A stable, aqueous degreaser composition as set forth in claim 1 wherein said organic solvent is 2-phenoxyethanol.

10. A stable, aqueous degreaser composition as set forth in claim 1 wherein said organic solvent is 1-phenoxy-2-propanol.

11. A stable, aqueous degreaser composition as set forth in claim 1 wherein said organic solvent is dipropylene glycol mono-n-butyl ether.

12. A stable, aqueous degreaser composition as set forth in claim 1 wherein said organic solvent is benzyl alcohol.

13. A stable, aqueous degreaser composition as set forth in claim 1 wherein said organic solvent is acetophenone.

14. A stable, aqueous degreaser composition as set forth in claim 1 wherein said solubilizing coupler is sodium cumene sulfonate.

15. A stable, aqueous degreaser composition as set forth in claim 1 wherein said solubilizing coupler is sodium xylene sulfonate.

16. A stable, aqueous degreaser composition as set forth in claim 1 wherein said solubilizing coupler is sodium octane-1-sulfonate.

17. A stable, aqueous degreaser composition as set forth in claim 1 wherein said solubilizing coupler is sodium 2-ethylhexyl sulfate.

18. A stable, aqueous degreaser composition as set forth in claim 1 wherein said solubilizing coupler is sodium pelargonate.

19. A stable, aqueous degreaser composition in the form of a totally water soluble solution and being free from foaming surfactants comprising:

(a) 2-phenoxyethanol is an amount exceeding its aqueous solubility;

(b) sodium cumene sulfonate in an amount not substantially exceeding twenty-five percent more than the amount minimally required to completely solubilize said 2-phenoxyethanol; and (c) water.

20. A stable, aqueous degreaser composition in the form of a totally water soluble solution and being free from foaming surfactants comprising:

(a) 1-phenoxy-2-propanol in an amount exceeding its aqueous solubility;

(b) sodium 2-ethylhexyl sulfate in an amount not substantially exceeding twenty-five percent more than the amount minimally required to completely solubilize said 1-phenoxy-2-propanol; and (c) water.

21. A stable, aqueous degreaser composition in the form of a totally water soluble solution and being free from foaming surfactants comprising:

(a) benzyl alcohol in an amount exceeding its aqueous solubility;

(b) sodium octane-1-sulfonate in an amount not substantially exceeding twenty-five percent more than the amount minimally required to completely solubilize said benzyl alcohol; and (c) water.

22. A stable, aqueous degreaser composition in the form of a totally water soluble solution and being free from foaming surfactants comprising:

(a) dipropylene glycol mono-n-butyl ether in an amount exceeding its aqueous solubility;

(b) sodium pelargonate in an amount not substantially exceeding twenty-five percent more than the amount minimally required to completely solubilize said dipropylene glycol mono-n-butyl ether; and (c) water.

* * * * *